US009803445B2

(12) United States Patent
Nguyen

(10) Patent No.: US 9,803,445 B2
(45) Date of Patent: Oct. 31, 2017

(54) SYSTEM AND METHOD TO SEAL MULTIPLE CONTROL LINES

(75) Inventor: Dennis P. Nguyen, Pearland, TX (US)

(73) Assignee: Cameron International Corporation, Houston, TX (US)

( * ) Notice: Subject to any disclaimer, the term of this patent is extended or adjusted under 35 U.S.C. 154(b) by 1482 days.

(21) Appl. No.: 12/669,040

(22) PCT Filed: May 20, 2008

(86) PCT No.: PCT/US2008/064264

§ 371 (c)(1),
(2), (4) Date: Jan. 13, 2010

(87) PCT Pub. No.: WO2009/014797

PCT Pub. Date: Jan. 29, 2009

(65) Prior Publication Data

US 2010/0206545 A1 Aug. 19, 2010

Related U.S. Application Data

(60) Provisional application No. 60/951,854, filed on Jul. 25, 2007.

(51) Int. Cl.

| | |
|---|---|
| ***E21B 33/068*** | (2006.01) |
| ***E21B 33/03*** | (2006.01) |
| ***E21B 33/076*** | (2006.01) |
| ***E21B 33/038*** | (2006.01) |

(52) U.S. Cl.
CPC ..... *E21B 33/038* (2013.01)

(58) Field of Classification Search
CPC ..... E21B 33/038
USPC ..... 166/88.3, 88.4, 368, 347; 277/337–339, 277/531
See application file for complete search history.

(56) References Cited

U.S. PATENT DOCUMENTS

| | | | | |
|---|---|---|---|---|
| 1,541,756 | A * | 6/1925 | Williams | 138/89 |
| 2,990,851 | A | 2/1958 | Jackson, Jr. et al. | |
| 3,380,520 | A | 4/1968 | Pease | |
| 3,814,179 | A | 6/1974 | Hull | |
| 3,840,071 | A * | 10/1974 | Baugh et al. | 166/338 |
| 4,181,175 | A | 1/1980 | Bridges et al. | |
| 4,267,401 | A * | 5/1981 | Wilkinson | 174/77 R |
| 4,444,218 | A | 4/1984 | Baugh | |
| 4,457,489 | A * | 7/1984 | Gilmore | 251/148 |
| 4,489,959 | A * | 12/1984 | Satterwhite | 285/18 |
| 4,607,701 | A | 8/1986 | Gundersen | |

(Continued)

FOREIGN PATENT DOCUMENTS

| | | |
|---|---|---|
| EP | 590410 | 4/1994 |
| WO | W09846922 | 10/1998 |

OTHER PUBLICATIONS

PCT International Search Report and Written Opinion for PCT/US2008/064264, dated Sep. 12, 2008.

*Primary Examiner* — James G Sayre
(74) *Attorney, Agent, or Firm* — Fletcher Yoder, P.C.

(57) ABSTRACT

A system in some embodiments includes sealing system including an energizing member that simultaneously seats a plurality of sealing elements about a plurality of control lines, respectively. Further embodiments provide a method including disposing a plurality of sealing elements about a plurality of control lines, respectively, and fastening an energizing member to simultaneously seat each of the sealing elements.

19 Claims, 5 Drawing Sheets

(56) References Cited

U.S. PATENT DOCUMENTS

| | | | | |
|---|---|---|---|---|
| 4,899,822 | A | 2/1990 | Daeschler et al. | |
| 5,861,577 | A * | 1/1999 | Tamura et al. | 174/50.56 |
| 6,076,605 | A | 6/2000 | Lilley et al. | |
| 6,644,410 | B1 | 11/2003 | Lindsey-Curran et al. | |
| 6,817,418 | B2 | 11/2004 | Gatherar et al. | |
| 7,032,935 | B1 * | 4/2006 | Levy et al. | 285/341 |
| 7,357,185 | B2 * | 4/2008 | Walker | 166/344 |
| 7,581,976 | B2 * | 9/2009 | Liepold et al. | 439/282 |
| 8,176,612 | B2 * | 5/2012 | Levy | 29/402.08 |
| 2004/0079532 | A1 | 4/2004 | Allen | |
| 2005/0006107 | A1 | 1/2005 | Nguyen et al. | |
| 2005/0167095 | A1 | 8/2005 | Nguyen | |

* cited by examiner

SYSTEM AND METHOD TO SEAL MULTIPLE CONTROL LINES

CROSS-REFERENCE TO RELATED APPLICATIONS

This application claims priority to and benefit of PCT Patent Application No. PCT/US2008/064264, entitled "System and Method to Seal Multiple Control Lines," filed May 20, 2008, which is herein incorporated by reference in its entirety, and which claims priority to and benefit of U.S. Provisional Patent Application No. 60/951,854, entitled "System and Method to Seal Multiple Control Lines", filed on Jul. 25, 2007, which is herein incorporated by reference in its entirety.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

As will be appreciated, oil and natural gas have a profound effect on modern economies and societies. In order to meet the demand for such natural resources, numerous companies invest significant amounts of time and money in searching for and extracting oil, natural gas, and other subterranean resources from the earth. Particularly, once a desired resource is discovered below the surface of the earth, drilling and production systems are often employed to access and extract the resource. These systems may be located onshore or offshore depending on the location of a desired resource. Further, such systems generally include a wellhead assembly through which the resource is extracted. These wellhead assemblies may include a wide variety of components and/or conduits, such as various control lines, casings, valves, and the like, that control drilling and/or extraction operations.

As will be appreciated, various control lines or other components of a production or transport system are typically coupled to one another to provide a path for hydraulic control fluid, chemical injections, or the like to be passed through the wellhead assembly. Such control lines are often disposed in various passages through components of the wellhead assembly, such as the tubing spool and/or the tubing hanger. In some instances, the control lines may experience high pressures. For instance, the annular region surrounding the control lines may be subjected to high pressures during testing and operation. Accordingly, seals are generally employed to seal the annular regions around the control lines. In addition, seals may be provided to connect the control lines to other components in the system. For example, the control lines may be routed to an external location where the lines are mated with other components, such as a control block.

Typically, each seal is manually installed at each seal location independent from other seals and seal locations. For example, an assembler may use a wrench to advance a fitting that seats a seal at each of the seal locations. However, in some applications, the space available for sealing and connecting the control lines may be limited and, thus, installing the seals may prove more difficult. Further, as the number of control lines within a system increases, the overall complexity and difficulty of connecting the lines may increase. For example, multiple control lines may reduce the space available for each control line and seal, and thus, increase the overall time and effort to seal the multiple control lines in the system.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components.

Certain exemplary embodiments of the present invention include a system and method that addresses one or more of the above-mentioned inadequacies of conventional control line sealing systems. As explained in greater detail below, the disclosed embodiments may include a plurality of control line metal seals, each having a load ring that is configured to engage ferrules to seal an annular gap located between control line tubing and the walls of a passage that houses the tubing. In certain embodiments, a single energizing member is employed to simultaneously engage a plurality of load rings and, thus, simultaneously seal the annular gaps about a plurality of control lines. For example, the energizing member may include a ring that simultaneously seals four control line tubing metal seals in an isolation flange control block. In other embodiments, the energizing member includes a ring employed to simultaneously seal four control line tubing metal seals atop four passages in a tubing hanger. In certain embodiments, the energizing member is engaged by a fastener, such as a bolt or other mechanism, tightened by an assembler.

Figure 1:
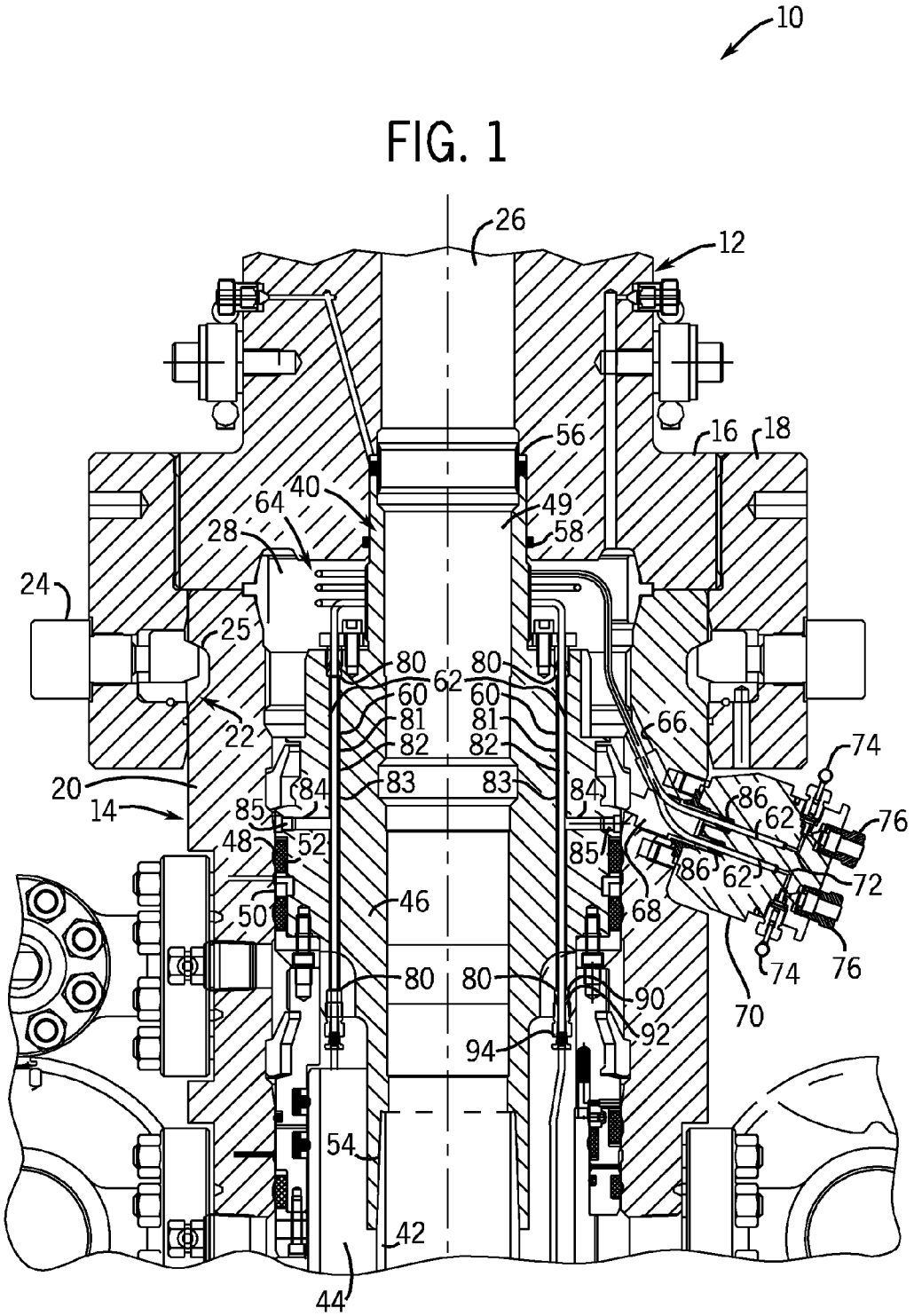
FIG. 1 is a cross-sectional view of an exemplary resource extraction system having multiple control line metal seals in accordance with an embodiment of the present technique.

FIG. 1 illustrates a cross-section of an exemplary embodiment of a wellhead system 10. The illustrated wellhead system 10 can be configured to extract various minerals, including hydrocarbons (e.g., oil and/or natural gas). In some embodiments, the system 10 may be land-based (e.g., a surface system) or disposed subsea (e.g., a subsea system). Further, the system 10 may be configured to extract minerals and/or inject other substances, such as chemicals used to improve the recovery of the mineral resources. For example, the system 10 may include or be coupled to a mineral extraction system, a mineral transportation system, a mineral processing system, such as a well, wellhead, subsea tree, mineral deposit, controller, a remote location, various tubing, or a combination thereof.

As illustrated, the system 10 includes a valve assembly that is colloquially referred to as a christmas tree 12 (hereinafter, a tree) coupled to a tubing spool 14. The tree 12 includes a tree body 16 and a tree connector 18. Similarly, the tubing spool 14 includes a tubing spool body 20 and a tubing spool connector 22 integral to the tubing spool 14. As depicted, the tree 12 is coupled to the tubing spool 14 via coupling the tree connector 18 to the tubing spool connector 22. The tree connector 18 includes latch pins 24 that engage receptacles 25 of the tubing spool connector 22. Similarly, the tubing spool 14 may include an additional connector that couples the tubing spool body 20 to a wellhead. For example, the tubing spool 14 may include a DWHC (Deep Water High Capacity) collet connector configured to couple the tubing spool 14 to a DWHC wellhead hub manufactured by Cameron, headquartered in Houston, Tex.

When assembled, the tree 12 includes a variety of flow paths (e.g., bores), valves, fittings, and controls for operating the well. For instance, the tree 12 may include a frame that is disposed about the tree body 16, a flow-loop, actuators, hydraulic actuators, valves, and the like. Generally, the tree body 16 includes a well bore 26 that provides access to the tubing spool 14, the wellhead hub and the sub-surface well bore, for example. Access to the sub-surface well bore may provide for various operations, such as the insertion of tubing or casing into the well, the injection of various chemicals into the well (down-hole), as well as other completion and workover procedures.

The illustrated tubing spool 14 includes a tubing spool cavity 28 that facilitates various operations similar to those described with regard to the tree 12. Additionally, the illustrated tubing spool cavity supports a tubing hanger 40. Assembly of the tubing hanger 40 to the tubing spool 14 may include connecting the tubing spool 14 to the wellhead hub, landing the tubing hanger 40 in the tubing spool cavity 28, and subsequently connecting the tree 12 to the tubing spool 14.

In the illustrated system 10, the tubing hanger 40 is located in the tubing spool 14, with both components 14 and 40 incorporating one or more seals to ensure that the well bore and an annulus 44 are hydraulically isolated. As illustrated, the tubing hanger 40 includes a tubing hanger body 46 that is sealed to the tubing spool 14 via a body seal 48 disposed between an internal surface 50 of the cavity 28 and an external surface 52 of the tubing hanger body 46. Further, the tubing hanger 40 includes a tubing hanger bore 49 that runs the length of the tubing hanger body 46. The tubing hanger bore 49 generally aligns with the well bore 26 of the tree 12. When the tree 12 is landed (as illustrated in FIG. 1), the well bore 26 may be mated to the tubing hanger bore 49 and may be sealed via metal seals 56 and 58. Further, the tubing string 42 may be threaded into a tubing thread 54, such that the tubing string 42 is suspended into the sub-surface well bore via the tubing hanger 40.

The tubing hanger 40 may also provide for continuous control lines to pass through the tubing hanger body 46 to control and gather data from downhole components, such as pumps valves, and the like. For example, the illustrated tubing hanger 40 includes multiple passages 60 running the length of the tubing hanger body 46 and control line tubing 62 disposed in each of the passages 60. Further, the control line tubing 62 may include an external connection that enables access to the control line tubing 62 from a location external to the wellhead system 10. For example, the control line tubing 62 includes multiple coils 64 that are disposed about an upper portion of the tubing hanger body 46, wherein the tubing 62 is routed out of the tubing spool cavity 28 via a first passage 66 and a second passage 68 in the tubing spool body 20. The depicted cross-section provides a view of two of the control line tubes 62 extending from the system 10, although four control line tubes 62 exit via the passages 66 and 68, as will be discussed in detail with regard to FIGS. 2, 3 and 4. The illustrated control line tubes 62 terminate into an isolation flange control block 70. The block 70 may provide for termination of the control lines 62, provide for coupling of various devices to the control lines 62, and provide for regulating pressures internal to the control line tubing 62. For example, the depicted block 70 includes control ports 72 that are each regulated by a needle valve 74. As illustrated, the control ports 72 are capped with test fittings 76.

In certain embodiments, it may be desirable to seal various locations proximate to the control line tubing 62. For example, the tubing hanger 40 generally includes control line tubing metal seals 80 located at each end of the passage 60 to seal an annular region 81 between the exterior 82 of the tubing 62 and the inside wall 83 of the passage 60. The seals 80 may enable pressurizing each of the passages 60 via a test port 84. For example, during testing, a test fitting 85 may be removed and a hydraulic fluid injected via the test port 84 to verify the integrity of the control line tubing 62 and the seals 80. Similarly, the system 10 may include tubing metal seals 86 at the termination of each of the four control line tubes 62. For example, the illustrated tubing metal seal 86 is provided proximate to the termination of the tubing 62 into to the block 70. The metal seals 86 may provide for isolating the pressure of the tubing spool cavity 28 from pressure in the control ports 72 and/or ambient pressures external to the system 10.

Generally, the seals 80 and 86 may include components that are designed to isolate the annular region surrounding the tubing 62. For example, the seals 80 and 86 may include Swagelok fittings (manufactured by Swagelok of Solon, Ohio) designed for use with ¼", ⅜", and the like tubing. In certain systems, the seals 80 and 86 each include a top ferrule 90 and a bottom ferrule 92 that are seated by exerting an axial load onto the ferrules. Each ferrule may generally include a bushing or adapter holding the end of a tube and inserted into a hole in a plate in order to make a tight fit. Discussed below is a system and method that that provides for simultaneously engaging and seating two or more of the plurality of seals 80 and 86. Rather than individually threading fittings 94 to seat each of the seals 80 and 86, embodiments provide for engaging a plurality of seals 80 and 86 via a single engagement feature. Further, the system may provide for connecting multiple control lines 62 to the block 70.

Figure 2:
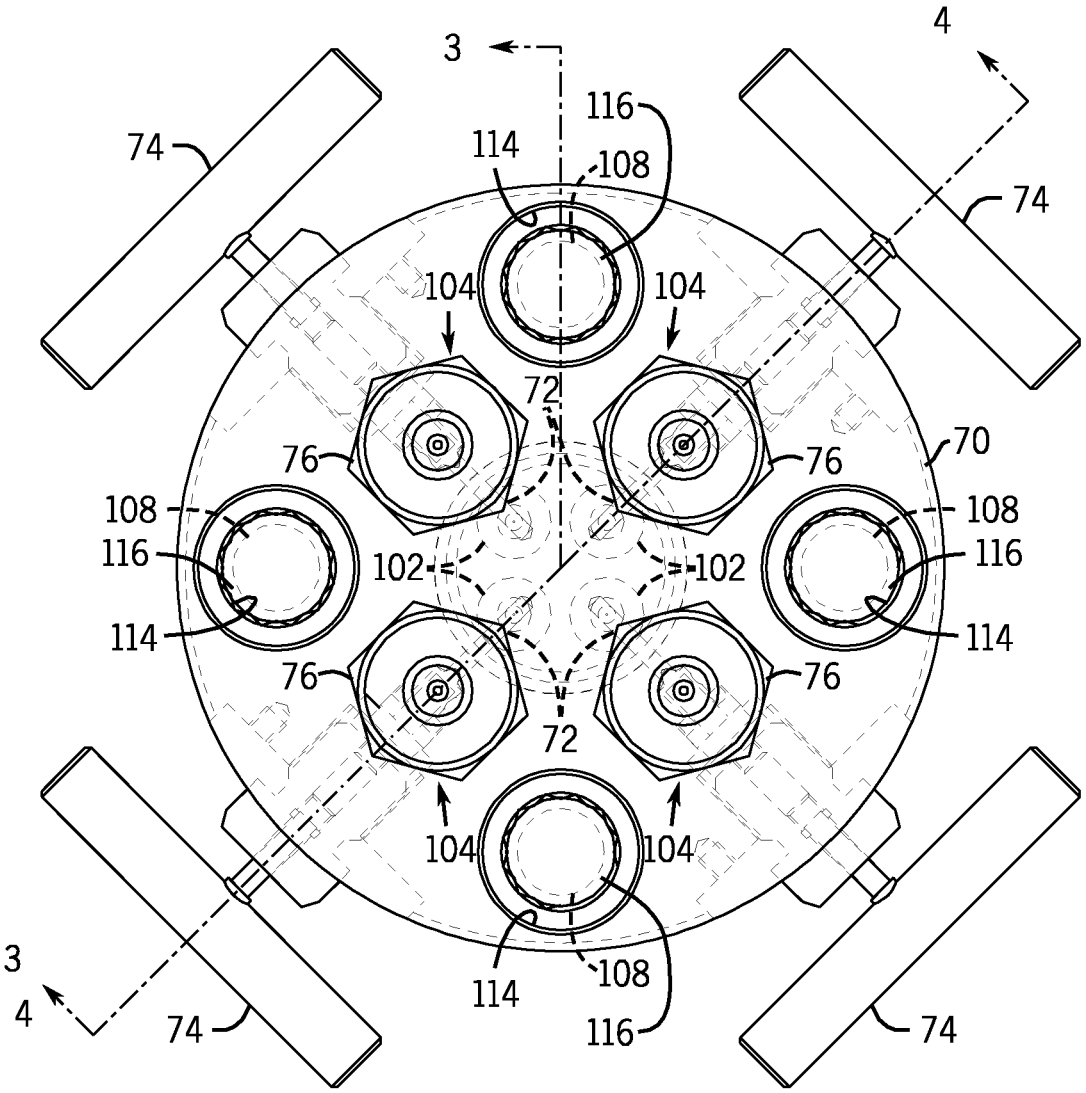
FIG. 2 is a top view of an embodiment of an isolation flange control block of the system of FIG. 1.
Figure 3:
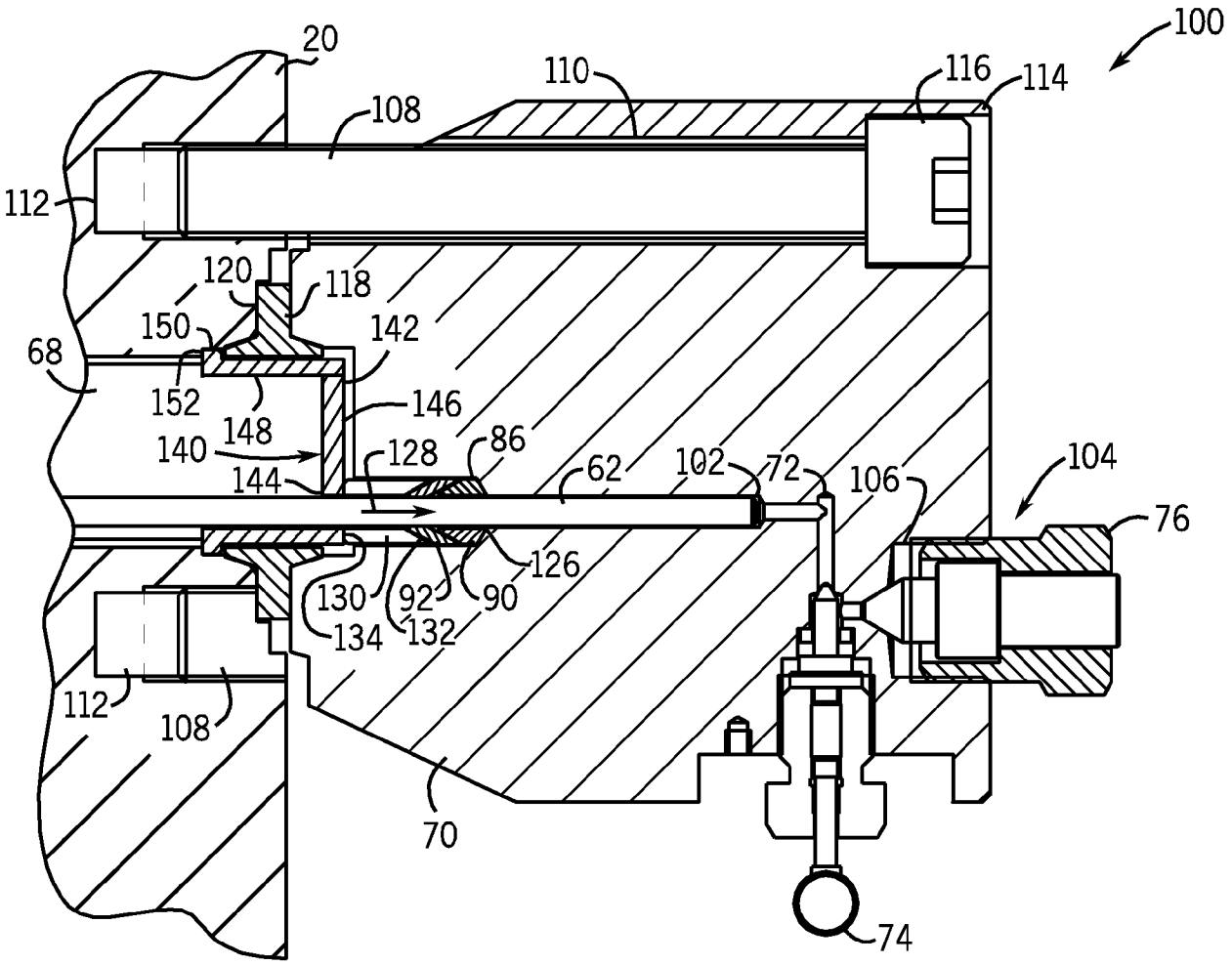
FIG. 3 is a cross-sectional view of the isolation flange control block across line 3-3 of FIG. 2.
Figure 4:
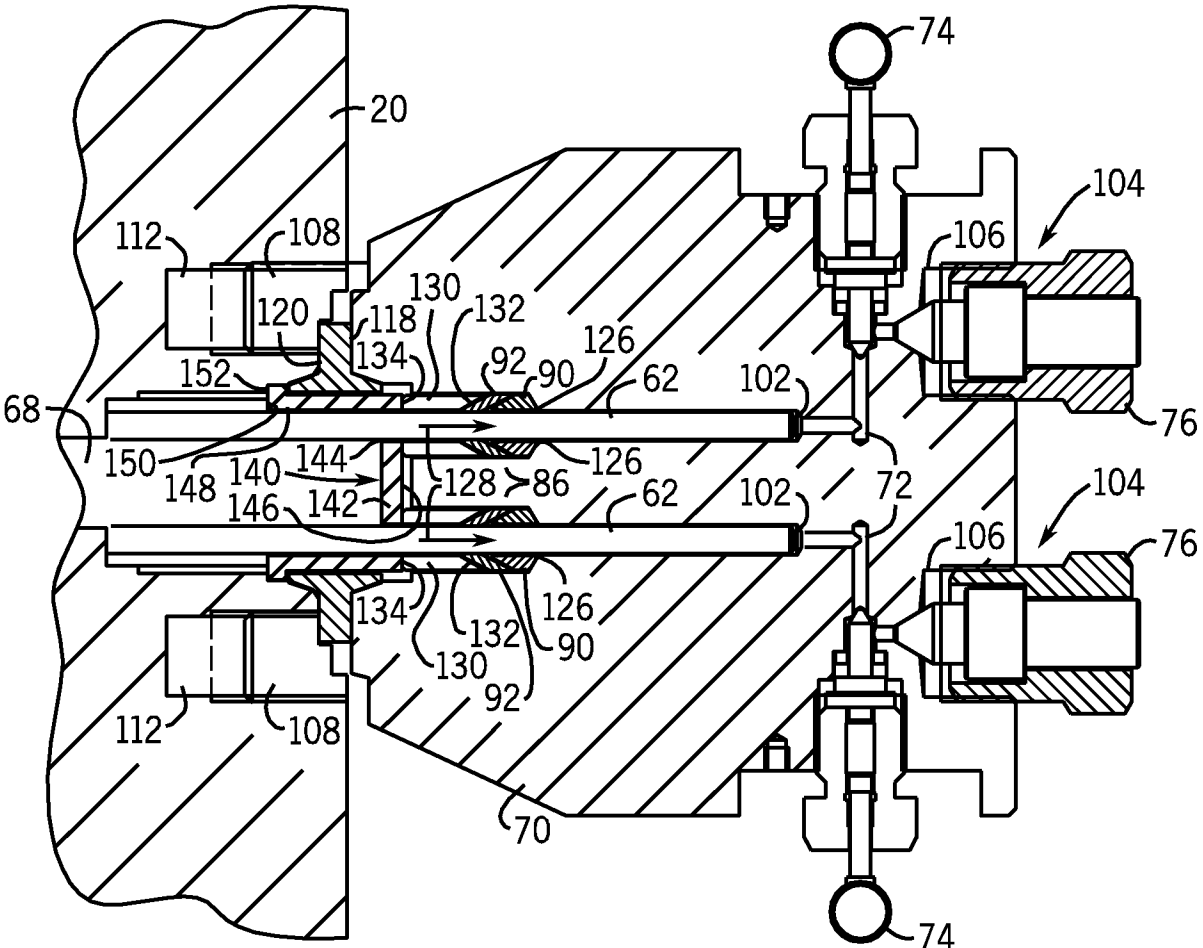
FIG. 4 is a cross-sectional view of the isolation flange control block across line 4-4 of FIG. 2.

FIGS. 2-4 illustrate a control block system 100 that includes an isolation flange block 70 and that is configured to connect to and seal multiple control lines 62. FIG. 2 depicts a top view of the control block system 100. FIGS. 3 and 4 include section views of the control block system 100 taken across lines 3-3 and 4-4, respectively. The control block system 100 may provide for termination and control of the control lines 62. For example, as depicted, four control lines 62 extend from the second passage 68 in the tubing spool body 20 and terminate into four passages 102 in the isolation flange control block 70. Each of the four passages 102 terminates into one of the control ports 72. The control ports 72 are regulated by the needle valve 74. The needle valve 74 may be opened or closed to provide a path to an external connection 104. As illustrated, the external connection 104 includes a thread 106 configured to accept a complementary fitting. For example, the thread 106 is mated to the test fitting 76. In other embodiments, an additional or different fitting may be mated to the thread 106 to provide for connections to other devices. For example, an embodiment may include coupling a monitor or a control device to the control block 70 via the thread 106 such that the pressure in the control line 62 and the control port 72 may be monitored or regulated.

The illustrated control block system 100 also includes four bolts 108 that are configured to attach the isolation control block 70 to the tubing spool body 20. For example, each of the bolts 108 is passed through a bolt hole 110 in the block 70 and coupled to a complementary bolt thread 112 disposed in the tubing spool body 20. As illustrated, the bolt hole 110 may also include a recess 114 configured to accept a head 116 of the bolt 108. Accordingly, tightening the bolt 108 may couple the block 70 to the tubing spool body 20.

Further, the illustrated control block system 100 includes a gray metal lock seal 118 disposed between the block 70 and the tubing spool body 20. The gray metal lock seal 118 may provide for isolating the tubing spool cavity 28 from the regions external to the system 10. For example, the gray metal lock seal 118 may seal external ambient pressure from entering the tubing spool cavity 28 via the first passage 66 and the second passage 68. The gray metal lock seal 118 may be set via tightening of the bolts 108. For example, tightening the bolts 108 may compress the gray metal lock seal 118 between the control block 70 and a complementary sealing surface 120 located on the tubing spool body 20. The angled surfaces of the seal may aid in providing a fluid seal as the block 70 is drawn toward the tubing spool body 20. In other words, the gray lock metal seal 118 may be wedged between the block 70 and the complementary sealing surface 120 located on the tubing spool body 20.

Each of the four passages 102 includes a bore that extends into the control block 70 and terminates into the control port 72. As discussed previously, the control port 72 is generally configured to provide a path to monitor and regulate the pressure internal to the control line tubing 62. Accordingly, the control line tubing metal seal 86 may be disposed such that the pressure internal to the control line tubing 62 is isolated from external pressures. For example, as illustrated in FIGS. 3 and 4, the control line tubing metal seal 86 is disposed about the control line tubing 62 such that it seals an annular gap 126 between the outer diameter of the tubing 62 and a wall of the passage 102. Sealing the annular gap 126 may provide a seal between the pressure of the second passage 68 and the passage 102 in the block 70, for instance.

In the illustrated embodiment, each of the control line tubing metal seals 86 includes at least one sealing component configured to provide a fluid seal between the wall of the passage 102 and the control line tubing 62. For example, the seal 86 includes the top ferrule 90 and the bottom ferrule 92 disposed atop one another. In such a configuration, an axial force provided in the direction of arrows 128 causes the metal seal 86 to seat such that a fluid seal is created. For example, an axial force in the direction of arrow 128 may cause an angled surface of the bottom ferrule 92 to react against an angled surface of the top ferrule 90, such that the top ferrule 90 seats and seals against the outer wall of the tubing 62 and the bottom ferrule 92 seats and seals against the wall of the passage 102. In other words, the axial force causes the ferrules 90 and 92 to wedgingly engage one another. The angled surfaces of the ferrules 90 and 92 may be conical or other wedge-shaped geometries. Further, a seal is created between the top ferrule 90 and bottom ferrule 92, such that a complete fluid seal is created across the annular gap 126. Other embodiments may include other forms of the metal seal 86. For example, the metal seal may include a single component or more than two components configured to provide a fluid seal of the annular gap 126.

The system 100 may also include a component to provide or transfer the axial force in the direction of arrow 128. For example, the depicted embodiment includes a load ring 130 disposed atop the bottom ferrule 92 of the control line tubing metal seal 86. The load ring 130 includes an engagement face 132, and a cylindrical body disposed about the control line tubing 62. The engagement face 132 includes a chamfer that is configured to engage components of the metal seal 86. For example, the chamfer includes an angle configured to properly engage the bottom ferrule 92 of the metal seal 86. Further, the load ring 130 includes a load face 134 that is configured to accept an axial load. In operation, the axial load in the direction of arrow 128 may be transferred from the load face 134 to the engagement face 132 and the metal seal 86, for example. Other embodiments may include variations of the load ring 130. For example, the load ring 130 may include a body of increased or decreased length to account for seating seals 86 disposed farther into the passage 102. Further, the load ring 130 may include various geometries to account for different metal seals 86 and passages 102. For example, the load ring 130 may include various diameters, and/or various engagement face 132 angles and shapes.

The axial load in the direction of arrow 128 may be provided to the load face 134 and the metal seal 86 from various sources. For example, as illustrated, an energizing ring 140 is disposed such that it can engage the load face 134 of the load ring 130. In other words, if the axial force is applied to the energizing ring 140, the axial force may be transmitted from the energizing ring 140 to the metal seal 86 via the load ring 130. Accordingly, providing an axial force to the energizing ring 140 seats the metal seal 86 to provide a fluid seal across the annular gap 126, as discussed previously.

In the illustrated embodiment, the energizing ring 140 includes a plate 142 that includes a plurality of tubing holes 144 through which the plurality of tubing 62 is disposed. Further, the plate 142 includes a load surface 146 that is configured to contact the load face 134 of the load ring 130. Accordingly, the energizing ring 140 is configured to transfer an axial force to seat the metal seal 86 and to slide relative to the tubing 62.

The axial force may be provided to the energizing ring 140 in a variety of configurations. In the illustrated embodiment, the axial force in the direction of arrow 128 is provided via the connection of the block 70 to the tubing spool body 20. For example, the energizing ring 140 includes a cylindrical body 148 and a lip 150 that is configured to mate with a reactive surface 152. The reactive surface 152 may include a milled recess in the tubing spool body 20, for instance. Accordingly, when the block 70 is bolted to the tubing spool body 20, the energizing ring 140 may resist inward axial movement in the direction of the reactive surface 152, and, thus, provide an opposite axial load (e.g., in the direction of arrow 128) to the load ring 130. As the bolt 108 is secured into the threads 112 of the tubing spool body 20, the block 70 may move inward in the direction toward tubing spool body 20 until the load ring 130 has engaged the metal seal 86, and the gray lock metal seal 118 is also seated. In other words, tightening the bolt 108 in a first direction may enable the energizing ring 140 to urge the seal 86 in an opposite direction to seat the seal 86. Other embodiments may include other fastening mechanisms to provide an axial force to the energizing ring 140. For example, the bolt 108 may be replaced with a cam mechanism that couples the block 70 to the tubing spool body 20. Further, an embodiment may include a cam mechanism on the block 70 that draws the energizing plate 140 into the load ring 130.

Further, the control block system 100 may be configured to seat and seal multiple control line tubing metal seals 86 simultaneously. For example, as best depicted in FIG. 4, the energizing ring 140 may be configured to engage multiple load rings 130 simultaneously. The cross-section of the energizing ring 140 illustrates the plate 142 including two of the four tubing holes 144. Thus, the energizing ring 140 surrounds each of the four control line tubes 62 and is configured to engage each of the four load rings 130 via the load surface 146. Accordingly, exerting a single axial load on the energizing ring 140 may simultaneously engage the load face 134 of each of the load rings 130, and enable each of the metal seals 86 to be seated simultaneously. For example, fastening the block 70 to the tubing spool body 20 may enable the energizing ring 140 to provide an axial force on each of the load rings 130 that is sufficient to seat the metal seals 86 and, thus, provide a simultaneous fluid seal of the four annular gaps 126. Other embodiments may include simultaneously seating and sealing any number of metal seals 86 simultaneously. The system 100 may include a single metal seal, two metal seals, three metal seals, five metals seals, six metal seals, seven metal seals, eight metal seals, or more than eight metal seals.

Other embodiments may include variations of the energizing ring 140. For example, an embodiment may include shortening or lengthening the body 148 to accommodate a specific application. Another embodiment may include resizing, reshaping, or even eliminating the lip 150. In yet another embodiment, the energizing ring 140 may consist only of the plate 142. Other embodiments may also include forming the energizing ring 140 into the tubing spool body 20. For example, the tubing spool body 20 may include a protrusion having the general profile of the energizing ring 140, and including four tubing holes 144.

Assembly of the control block system 100 may include a variety of steps. For example, the control line tubing 62 may first be routed through the first passage 66 and the second passage 68 of the tubing spool body 20. The control line tubing 62 may be routed through the tubing holes 144 of the energizing ring 140, and the energizing ring 140 may be set in place (e.g., seated in a milled region including the reactive surface 152). Next, the gray lock metal seal 118 may be set in a complementary recess and about the energizing ring 140. With the control line tubing 62 threaded through the energizing ring 140, the load ring 130, the bottom ferrule 92, and the top ferrule 90 may be placed over each control line tube 62. Subsequently, the isolation flange control block 70 may be coupled to the tubing spool body 20 such that the energizing ring 140 exerts an axial load on each load ring 130, and the bottom ferrule 92 and top ferrule 90 are seated to seal the annular gap 126. Other embodiments may include variations to those procedures described above. For example, the gray lock metal seal 118 may not be included in all embodiments. Further, the load rings 130, the bottom ferrule 92 and top ferrule 90 may be placed in the passage 102 prior to assembly of the control block 70 to the tubing spool body 20.

Figure 5:
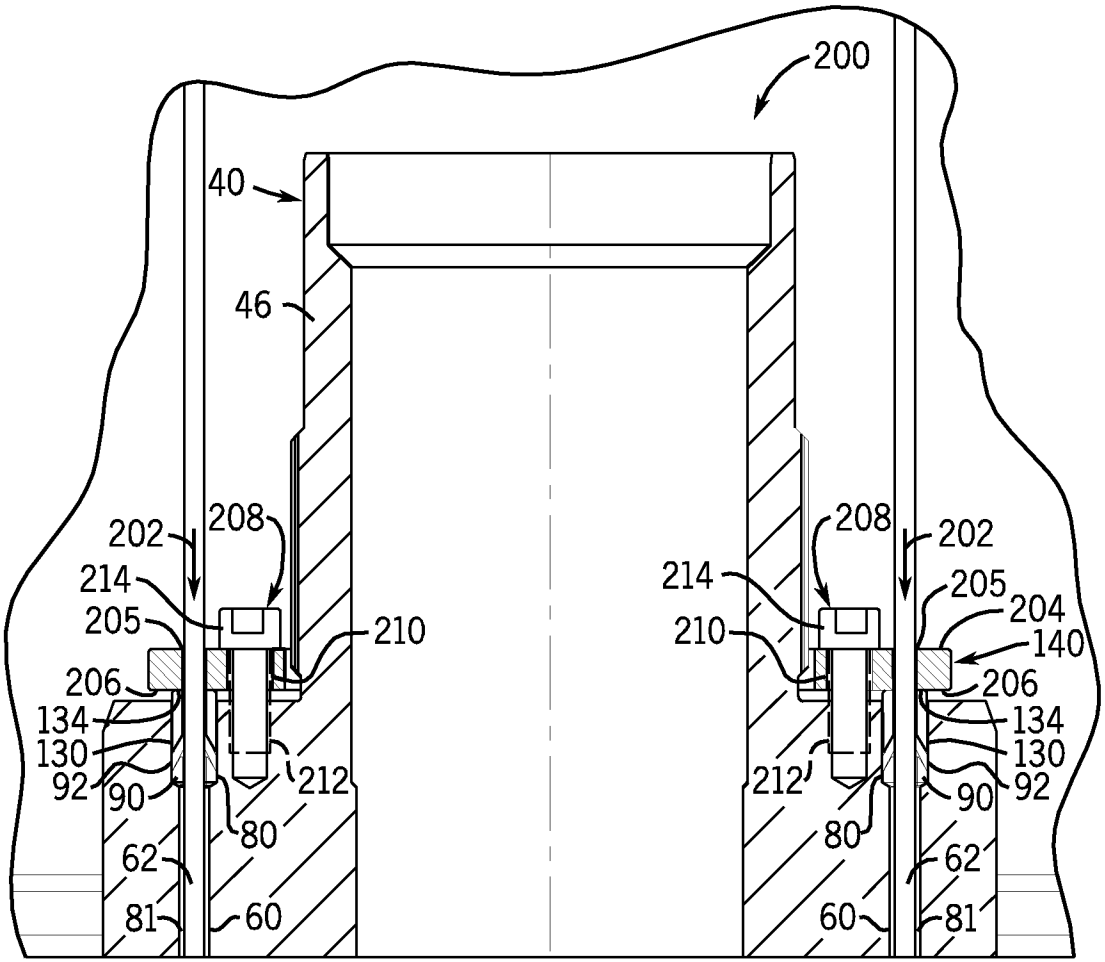
FIG. 5 is a cross-sectional view of an embodiment of tubing hanger of the system of FIG. 1.

FIG. 5 illustrates an embodiment of the system 10 including a tubing hanger sealing system 200. As discussed previously, the tubing hanger body 46 includes four passages 60 that each include a continuous control line tubing 62. The tubing hanger 40 also includes control line tubing metal seals 80 located at each end of the passages 60 to seal the annular region 81 between the exterior of the tubing 62 and the inside wall of the passages 60. These seals 80 may enable pressurizing each of the passages 60 via the test port 84, as previously discussed. The metal seals 80 may include multiple components, including at least one sealing component configured to provide a fluid seal in the annular region 81. For example, the depicted metal seals 80 include the top ferrule 90 and the bottom ferrule 92 disposed atop one another. In such a configuration, an axial force provided in the direction of arrows 202 may cause the metal seal 80 to seat such that a fluid seal is created. For example, an axial force in the direction of arrow 202 may cause an angled surface of the bottom ferrule 92 to react against an angled surface of the top ferrule 90, such that the top ferrule 90 seats and seals against the outer wall of the tubing 62 and the bottom ferrule 92 seats and seals against the wall of the passage 60. In other words, the axial force causes the ferrules 90 and 92 to wedgingly engage one another. The angled surfaces of the ferrules 90 and 92 may be conical or other wedge-shaped geometries. Further, a seal is created between the top ferrule 90 and bottom ferrule 92, such that a complete fluid seal is created across the annular region 81. Other embodiments may include other forms of the metal seal 86. For example, the metal seal may include a single component or more than two components configured to provide a fluid seal of the annular gap 81.

Similar to the embodiments discussed with regard to FIGS. 2-4, in addition to the metal seals 80, the system 200 may also include the load ring 130 and the energizing ring 140. For example, the load ring 130 may be disposed atop the bottom ferrule 92 of the control line tubing metal seal 80, in a configuration similar to that discussed previously. Accordingly, an axial force provided in the direction of arrows 202 may cause the metal seal 80 to seat and provide a fluid seal of the annular region 81.

In the illustrated embodiment, the energizing ring 140 includes a plate 204 that includes a plurality of tubing holes 205 through which the tubing 62 can be disposed. For example, the depicted ring 140 includes four holes 205 disposed in a circular pattern about an axis of the plate 204. Further, the plate 204 includes a load surface 206 that is configured to contact the load face 134 of the load ring 130.

Accordingly, the energizing ring 140 is configured to transfer an axial force to set the metal seal 80 and to slide relative to the tubing 62.

In the illustrated embodiment, the axial force in the direction of arrow 202 is provided via a fastener 208 that directly couples to the energizing ring 140. For example, the fastener 208 is passed though a fastener hole 210 in the energizing ring 140 and is coupled to a thread 212 in the tubing hanger body 46. Accordingly, threading the fastener 208 into the thread 212 urges a head 214 of the fastener 208 into contact with the energizing ring 140. In other words, as the fastener 208 is tightened, the head 214 of the fastener 208 forces the energizing ring 140 in the direction of arrow 202. The force on the energizing ring 140 is transmitted to the load ring 130 via the load surface 206 of the energizing ring 140 and the opposing load face 134 of the load ring 130. Thus, continuing to tighten the fastener 208 may provide a sufficient force to seat the metal seal 80 and provide a fluid seal across the annular region 81.

Further, the system 200 may be configured to seat and seal multiple control line tubing metal seals 80 simultaneously. For example, the energizing ring 140 may be configured to engage multiple load rings 130 simultaneously. The cross-section of the energizing ring 140 illustrates the plate 204 including two of four tubing holes 205, for example. The energizing ring 140 surrounds each of the four control line tubes 62 and is configured to engage each of the four load rings 130 via the load surface 206. Accordingly, exerting a single axial load on the energizing ring 140 may simultaneously engage each load face 134 of the load rings 130, and enable each of the metal seals 80 to be seated simultaneously. For example, tightening the fastener 208 may enable the energizing ring 140 to provide an axial force that is sufficient to seat each of the metal seals 80 and, thus, provide a simultaneous fluid seal of the four annular regions 81. Other embodiments may include seating any number of metal seals 80 simultaneously. For example, the system 200 may include a single metal seal, two metal seals, three metal seals, five metals seals, six metal seals, seven metal seals, eight metal seals, or more than eight metal seals.

In certain embodiments, the energizing ring 140 may include a plurality of features configured to enable operation of the system 200, as described above. For example, the illustrated emerging ring 140 includes offsetting the fastener hole 210 from the tubing holes 205 (e.g., not coaxial). Offsetting the holes may provide for improved access for an assembler to seat the seals 80. For example, where a typical threaded fitting may be located along the axis (e.g., coaxial) of the passage 60 and directly under the coils 64, the fastener 208 and fastener hole 210 may be offset from such a location to provide access to the fastener 208 with a socket or other tool for tightening the fastener 208.

Further, the system 200 may include a single fastener 208 or any number of fasteners 208 to provide the axial force sufficient to seat the seals 80. For example, as depicted, the system includes four fasteners 208 evenly spaced in a circular pattern. Other embodiment may include an increased or decreased number of fasteners 208. For example, embodiments may include one, two, three, five, six, seven, eight, or more fasteners 208 coupling the energizing ring 140 to the tubing hanger 40. Further, other embodiments may include various patterns. For example, in an embodiment that includes four fasteners 208, two of the fasteners 208 may be disposed at one radius, with the remaining two fasteners 208 disposed at another radius.

Assembly of the system 200 may include a variety of steps. For example, the control line tubing 62 may, first, be routed through the passages 60 of the tubing hanger body 46. Next, the load ring 130, bottom ferrule 92 and the top ferrule 90 may be placed over each control line tube 62 and disposed in or atop each passage 60. The control line tubing 62 may, then, be routed through the tubing holes 205 of the energizing ring 140, and the energizing ring 140 may be set in place (e.g., rested on the seals 80). With the control line tubing 62 disposed through the energizing ring 140, the fasteners 208 may be disposed through the holes 210 and subsequently fastened to the threads 212. The fasteners 214 may be tightened until the energizing ring 140 contacts the tubing hanger body 46, and/or the seals 80 are seated. Other embodiments may include variations to those procedures described above. For example, the tubing 62 may be bent to form coils 64 before or after installing the tubing 62 in the passages 60. Further, the seals 80 and load ring may be placed about the tubing 62 before the tubing is disposed in the passages 60.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:

a control line configured to extend into a bore;

an annular seal coaxial with and surrounding the control line, wherein the annular seal comprises a load ring or a ferrule disposed in the same bore as the control line;

a fastener at an offset and external from the control line and the annular seal; and an energizing member configured to bias the annular seal toward a seated position with the control line in response to movement of the fastener.

2. The system of claim 1, wherein the energizing member is configured to simultaneously bias a plurality of annular seals about a plurality of control lines, respectively.

3. The system of claim 1, wherein the fastener is configured to move in a first direction and the energizing member is configured to move the annular seal in a second direction different from the first direction of the fastener.

4. The system of claim 3, wherein the first and second directions are opposite from one another.

5. The system of claim 1, wherein the control line is coupled to a mineral extraction system, a mineral transportation system, a mineral processing system, or a combination thereof.

6. The system of claim 1, wherein the annular seal is configured to seal the control line with a control block of a subsea christmas tree.

7. The system of claim 1, wherein the ferrule comprises a plurality of ferrules configured to wedgingly engage one another.

8. The system of claim 1, wherein the annular seal is an annular metallic seal.

9. A system, comprising:

a plurality of load rings configured to mount around and move axially about a plurality of control lines, wherein a first load ring surrounds a first control line but not a second control line, and a second load ring surrounds the second control line but not the first control line; and an energizing member configured to bias the plurality of load rings for simultaneously energizing and seating a plurality of sealing elements about the plurality of control lines, respectively.

10. The system of claim 9, wherein the sealing elements each comprise a ferrule.

11. The system of claim 9, wherein the sealing elements each comprise a plurality of ferrules configured to wedgingly engage one another.

12. The system of claim 9, comprising a fastener configured to bias the energizing member, wherein the fastener is configured to mount at an offset and external from the plurality of load rings, the plurality of control lines, and the plurality of sealing elements.

13. The system of claim 9, comprising a mineral resource system having the plurality of sealing elements, the plurality of control lines, the plurality of load rings, and the energizing member, wherein the mineral resource system comprises a fluid line control block, a well, a wellhead, a subsea tree, a mineral deposit, a valve, a controller, a remote station, tubing, or a combination thereof.

14. A system, comprising:

a control block comprising a plurality of passages each having a control line and an annular seal coaxial with the control line, wherein a force applied to an energizing member is configured to simultaneously couple and seat the annular seals coaxially with the control lines associated with the plurality of passages, respectively; and a fastener offset and external from the passages and the annular seal, wherein the fastener is configured to provide the force to the energizing member.

15. The system of claim 14, wherein the fastener is configured to move in a first direction and the energizing member is configured to move the annular seal in a second direction different from the first direction of the fastener.

16. The system of claim 14, wherein the energizing member comprises a plate, a body, and a lip.

17. The system of claim 14, comprising a plurality of load rings disposed between the energizing member and the annular seals, respectively.

18. The system of claim 14, wherein each annular seal comprises a ferrule.

19. The system of claim 14, wherein the control line is configured to accept a fluid pressure to control and/or monitor components coupled to a wellhead system.

* * * * *